United States Patent [19]

Van Linder et al.

[11] 4,187,966

[45] Feb. 12, 1980

[54] METAL DISPENSING VALVE ASSEMBLY FOR BATTERY GRID CASTING MACHINE

[75] Inventors: Basil R. Van Linder, Oshtemo Township, Kalamazoo County; Ronald C. Van Linder, Watervliet Township, Berrien County; Fredrick G. McLane, Portage, all of Mich.

[73] Assignee: Kalamazoo Manufacturing Company, Kalamazoo, Mich.

[21] Appl. No.: 936,099

[22] Filed: Aug. 23, 1978

[51] Int. Cl.[2] ..... B22D 41/10

[52] U.S. Cl. ..... 222/601; 222/525; 222/532; 251/356

[58] Field of Search ..... 251/332, 356; 222/559, 222/509, 525, 532, 601

[56] References Cited

U.S. PATENT DOCUMENTS

| | | | |
|---|---|---|---|
| 2,891,291 | 6/1959 | Schnacke | 222/601 |
| 3,786,962 | 1/1974 | Van Linder | 222/559 X |
| 3,877,620 | 4/1975 | Rader | 222/601 X |
| 4,022,356 | 5/1977 | McLane | 222/601 X |

*Primary Examiner*—David A. Scherbel

*Attorney, Agent, or Firm*—Blanchard, Flynn, Thiel, Boutell & Tanis

[57] ABSTRACT

A valve assembly for dispensing a predetermined amount of molten metal to a mold filling ladle of a battery grid casting machine. The valve assembly includes a substantially tubular body having an interior chamber therein. A discharge spout projects downwardly from the chamber. An upwardly opening dispenser cup is positioned within the chamber and is supported for limited sideward displacement. The dispenser cup has a substantially annular valve element positioned in the interior thereof. A supply nozzle projects downwardly through the upper end of the body into said chamber, and projects into the interior of the cup for engagement with the valve member. Relative vertical displacement between the body and the nozzle permits controlled flow of molten metal from the nozzle into the dispenser cup and then into the chamber for discharge through the spout. The cup maintains a predetermined quantity of molten metal therein at all times, even when the valve assembly is closed, so that the valve member is continuously and completely immersed in molten metal.

10 Claims, 4 Drawing Figures

METAL DISPENSING VALVE ASSEMBLY FOR BATTERY GRID CASTING MACHINE

FIELD OF THE INVENTION

This invention relates to a battery grid casting machine and, more particularly, to an improved valve mechanism for periodically dispensing a predetermined quantity of molten metal into a mold-filling ladle.

BACKGROUND OF THE INVENTION

Battery grid casting machines conventionally employ a valve mechanism for dispensing a predetermined amount of molten metal into a mold-filling ladle during each cycle of the machine. The ladle is then tipped to pour the charge of molten metal into the cavity of the closed mold. Valve mechanisms of this type must be capable of operating freely without undue friction so as to dispense the requisite charge of molten metal at the proper time. This is particularly true where the quantity of metal dispensed is controlled by opening the valve a predetermined extent for a predetermined time period. With some valve constructions, this is difficult to achieve since the temperature of the molten metal is extremely high and tends to produce distortions and cause misalignment and malfunctioning of the valve. It thus becomes important that such valves be constructed so that their proper functioning is not adversely affected by relatively high temperatures.

In an attempt to meet the above objectives, numerous valves have been proposed which have provided a valve member or ball which is laterally movable relative to the supply nozzle to thereby insure proper alignment and hence proper closure of the valve. An example of such constructions is disclosed in U.S. Pat. Nos. 3,877,620 and 4,022,356.

While the known valve constructions, such as those illustrated in the above patents, have tended to minimize the problem of distortion and misalignment, nevertheless these valve constructions have possessed other disadvantages which have significantly interfered with the desired and efficient operation of the battery grid casting machine. More specifically, the valve member in the known valve constructions has been subject to the problem of oxidation inasmuch as a substantial portion of the valve member is exposed to the air and gases which are supplied to the valve housing during that portion of the cycle when the valve member is closed. These hot gases, and the intermittent exposure of the valve member to the molten metal, thus results in oxidation whereby oxides and deposits collect on the valve member and hence interfere with the proper seating thereof with the supply nozzle. This thus necessarily requires substantial maintenance of the valve assembly, and often requires replacing the valve member. This in itself creates substantial difficulty in many known valve constructions, since the disassembly and replacement of the valve member is a difficult and time-consuming task.

Accordingly, it is an object of the present invention to provide an improved valve mechanism for a battery grid casting machine, which valve mechanism overcomes the above disadvantages.

More specifically, the present invention relates to an improved valve mechanism, as aforesaid, which permits a predetermined quantity of molten metal to be periodically supplied to a grid casting machine, which valve mechanism in turn employs a valve member which is continuously immersed and surrounded by the molten metal so as to prevent oxidation and hence build-up of deposits thereon.

A further object is to provide a valve mechanism, as aforesaid, wherein the valve member is supported for limited sideward displacement relative to the supply nozzle to thereby insure proper alignment therebetween at all times, thereby compensating for distortions caused by high temperatures and the like.

Still a further object is to provide an improved valve mechanism, as aforesaid, wherein an upwardly opening dispenser cup is horizontally movably supported within an interior chamber defined within a tubular housing, which dispenser cup has the valve member positioned in the bottom thereof and disposed for cooperation with the lower end of the supply nozzle, whereby a predetermined quantity of molten metal is maintained in the cup at all times to thereby completely surround and immerse the valve member, both when the valve mechanism is opened and closed.

Another object is to provide an improved valve mechanism, as aforesaid, which can be efficiently and easily disassembled, and reassembled, to permit any required maintenance or repair of the valve assembly while requiring a minimum amount of labor and time and hence a minimum shutdown of the casting machine.

Other objects and purposes of the invention will be apparent to persons familiar with apparatus of this general type upon reading the following specification and inspecting the accompanying drawings.

Figure 1:
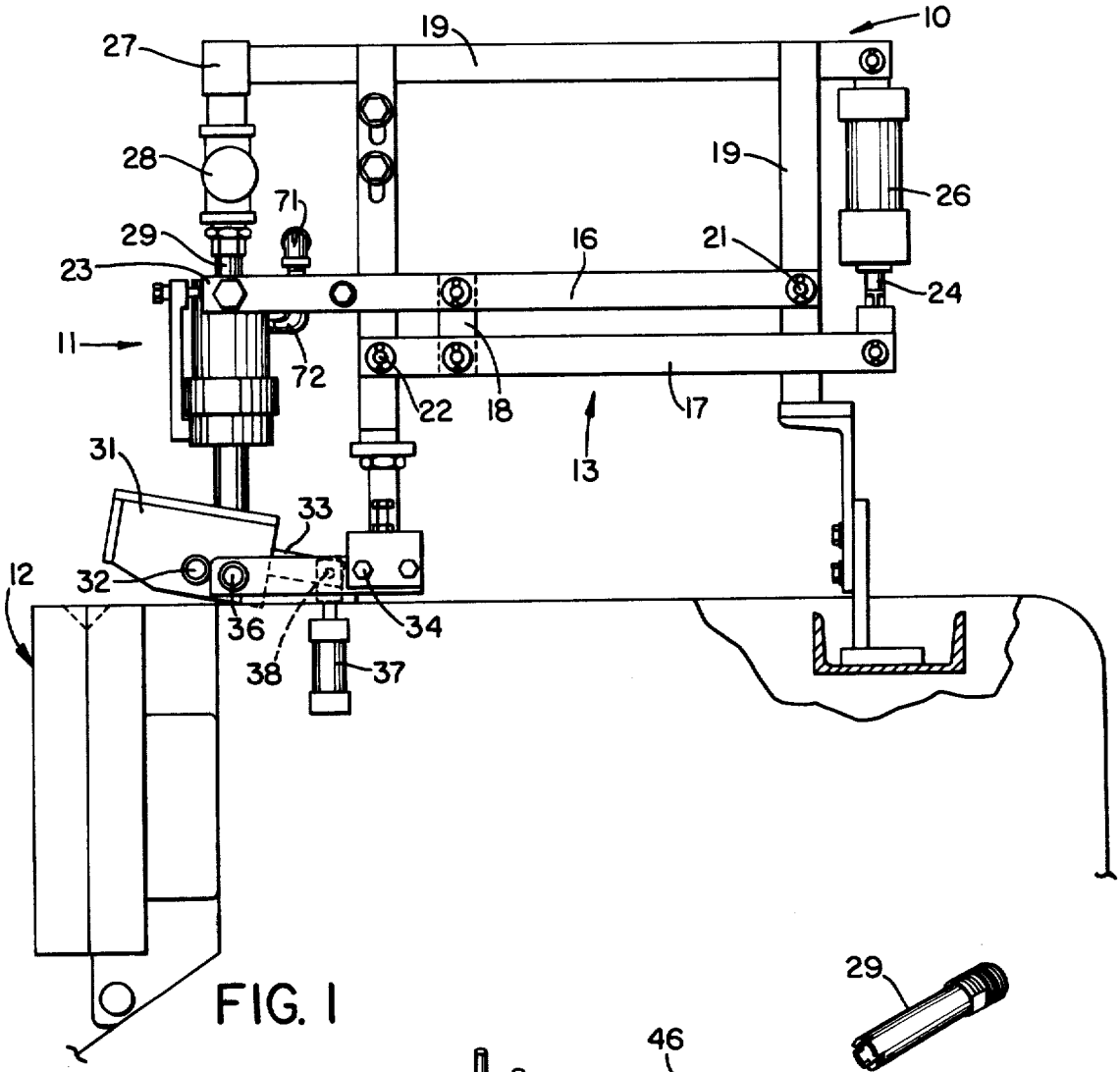
FIG. 1 is a side elevational view of the valve mechanism and the valve operating assembly according to the present invention.
Figure 4:
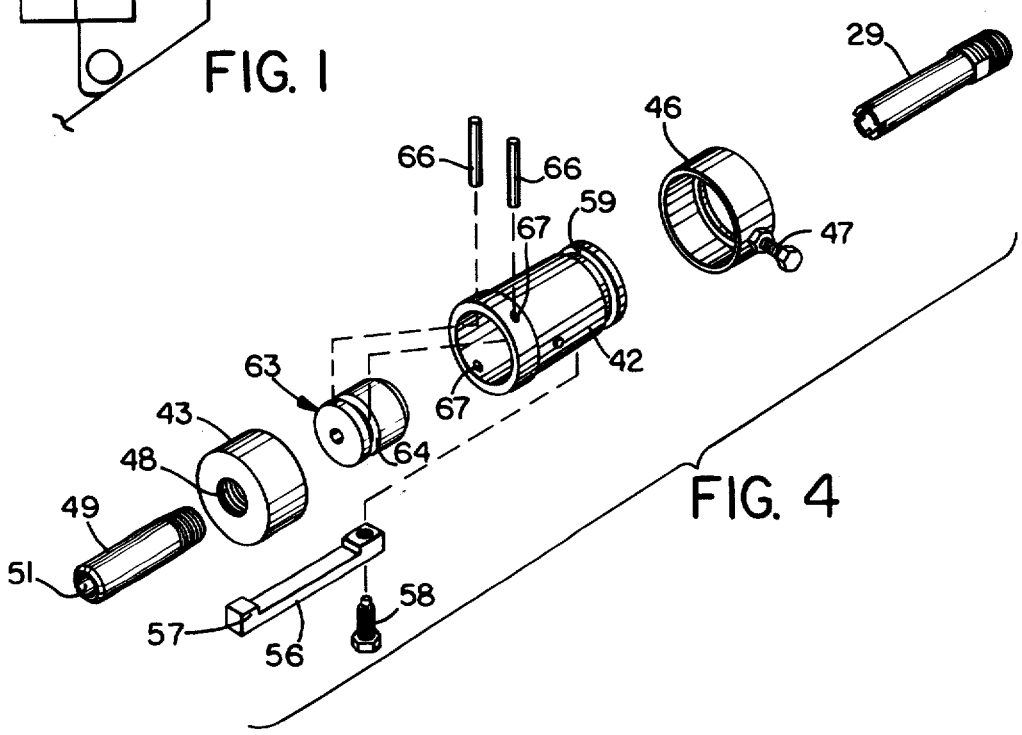
FIG. 4 is an exploded, perspective view of the valve mechanism.

Certain terminology will be used in the following description for convenience in reference only and will not be limiting. For example, the words "rightwardly", "leftwardly", "upwardly" and "downwardly" will refer to directions in the drawings to which reference is made. The words "inwardly" and "outwardly" will refer to directions toward and away from, respectively, the geometric center of the valve mechanism and designated parts thereof. Said terminology will include the words specifically mentioned, derivatives thereof, and words of similar import.

SUMMARY OF THE INVENTION

The objects and purposes of this invention, including those mentioned above, have been met by providing a valve mechanism which employs a body formed from upper and lower cup-shaped elements disposed in opposed relationship to define an interior chamber. A discharge spout communicates with said interior chamber and projects axially downwardly from said body for discharging molten metal into a ladle. A supply tube or nozzle projects axially downwardly through the upper element into the interior chamber, which supply nozzle communicates with a conventional source of metal. A dispenser cup is positioned within the interior chamber and is movable sidewardly relative to the body and relative to the supply nozzle. The cup opens upwardly and has a valve member in the interior thereof. A lower end of the nozzle projects into the dispenser cup and has a valve seat which is engageable with the valve member to prevent flow through the valve mechanism. Relative separation between the body and the supply nozzle opens the valve mechanism and permits flow past the valve member into the dispenser cup, whereupon the molten metal overflows the dispenser cup into the interior chamber, and then is discharged through the spout into the ladle. The dispenser cup maintains a predetermined quantity of molten metal therein at all times, so that the valve member is continuously surrounded and immersed in the molten metal when the valve mechanism is in both the open and closed positions

DETAILED DESCRIPTION

Referring to FIG. 1, there is illustrated an apparatus 10 for controlling the flow and supply of a molten metal, such as lead, to a casting machine, specifically a battery grid casting machine. The apparatus 10 includes a valve mechanism 11 for controlling the quantity of molten metal supplied to a mold 12, which valve mechanism is actuated by an operating means 13.

The operating means 13 includes a vertically swingable parallelogram linkage formed by upper and lower levers 16 and 17, respectively, pivotally connected together by intermediate link 18. The levers 16 and 17 are pivotally supported on the frame 19 at pivot points 21 and 22, respectively. The forward end of the upper lever 16 terminates in a fork or U-shaped portion 23 which in turn surrounds and supports the valve mechanism 11. The opposite or rearward end of the lower lever 17 is pivotally connected to the piston rod 24 of a fluid pressure cylinder 26, specifically a pneumatic cylinder, the housing of which is pivotally anchored to the frame 19. The frame 19 is provided with a bracket structure 27 by which the frame is secured to an inlet pipe 28, which pipe supplies the molten metal to the valve mechanism 11 through the downwardly directed supply nozzle 29. The inlet pipe 28 is in turn connected to a source of molten metal in a conventional manner, which metal may be supplied to the pipe 28 by being pumped thereto, or alternately the molten metal may be stored in a suitable reservoir positioned at an elevation above the pipe 28 so as to be supplied thereto by gravity.

The predetermined quantity of molten metal which is supplied through the valve mechanism 11 is deposited in a conventional ladle 31 which is disposed directly above the mold 12 and is pivotally supported about a stationary pivot 32. The ladle is pivotally actuated by a lever 33 which is pivotally supported at 34 on the frame 19. The forward end of lever 33 is pivoted to the ladle at 36. A conventional fluid pressure cylinder 37, such as a pneumatic cylinder, has the piston rod thereof pivotally connected to the lever at 38 so that energization of the cylinder causes upward swinging of the lever 33, thereby causing counterclockwise pivoting of the ladle to thereby dump the molten metal therein into the mold 12. The overall apparatus 10 as described above, is substantially conventional, except for the specifics of the valve mechanism 11, as described hereinafter.

Figure 2:
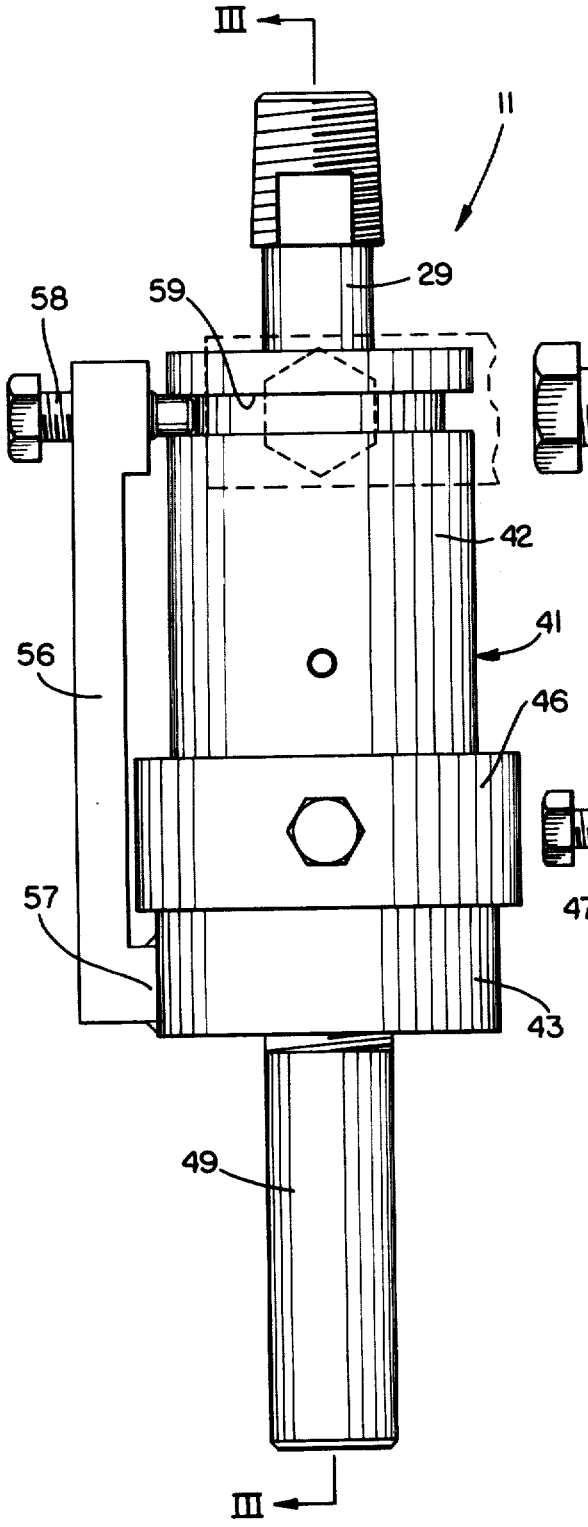
FIG. 2 is an enlarged, side elevational view of the valve mechanism.

Considering now the valve mechanism 11, as illustrated in FIGS. 2≧4, some includes a body structure 41 formed by upper and lower cup-shaped body members 42 and 43, respectively, which are disposed in opposed relationship to define an interior chamber 44 therebetween. An annular cap 46 is disposed in slidable surrounding relationship to the upper body member 42 and axially overlaps the lower body member 43. A threaded set screw 47 is mounted on the cap 46 and, when tightened, fixedly engages the lower body member 43 to thereby fixedly connect the body members 42 and 43 together.

The lower body member 43 has a threaded opening 48 extending coaxially through the lower wall thereof, and the upper end of a discharge tube or spout 49 is threaded into the opening 48. This spout 49 defines an interior discharge passage 51 which coaxially communicates with the lower end of the chamber 44.

The upper body member 42 also has an opening 52 extending coaxially through the upper wall thereof, and the metal supply tube or nozzle member 29 freely slidably projects through this opening 52 so that the lower end of the nozzle 29 is thus disposed within the interior chamber 44. The nozzle 29 and spout 49 are thus substantially coaxially aligned but vertically displaced. The lower end of nozzle 29 has a sleeve-like orifice member 53 fixed coaxially therein, as by being press fitted into the lower end of the nozzle. This orifice member 53 defines an annular valve seat 54 on the lower end thereof.

The upper and lower body members 42 and 43 are additionally releasably but fixedly secured together by an elongated support bar 56 which has the lower end portion 57 thereof fixed to the lower body member 43, as by being welded thereto. The upper end of support bar 56 has a threaded locking screw or bolt 58 associated therewith, which bolt projects into an annular groove 59 which externally surrounds the upper body member 42 to thereby axially lock the body members 42 and 43 together.

The annular groove 59 associated with the upper body member 43 also receives therein, on diametrically opposite sides of the body member, a pair of support pins 61, which pins are fixed to the fork portion 23 of the upper operating lever 16. An upwardly opening cup-shaped member 63, hereinafter referred to as the cup, is positioned within the interior chamber 44, being positioned between and substantially coaxially aligned with the nozzle 29 and spout 49. The cup 63 has an annular groove 64 extending exteriorly therearound, which groove receives therein a pair of substantially parallel support pins 66. These pins 66 extend horizontally across the chamber 44 and the ends of these pins are received within openings 67 formed in the upper body member 42 so that the pins are thus stationarily supported thereon. The pins are confined, and normally prevented from being removed, by the surrounding annular cap 46. The pins 66 are loosely received within the groove 64 so that the cup 63 can thus freely move sidewardly in a horizontal plane as necessary in order to provide the desired alignment while at the same time compensate for distortions, such as caused by the high temperature of the molten metal. This arrangement for supporting the cup 63 enables the cup to move sidewardly in substantially perpendicular relationship to the longitudinal direction of the pins 66, and also enables the cup to move in a direction substantially parallel to the longitudinal direction of the pins 66. The provision of the annular groove 64 also enables the cup 63 to rotate relative to the surrounding body structure 41 about an axis parallel to the longitudinal axis of the supply nozzle.

The cup 63 defines therein an interior upwardly opening chamber or reservoir 67, into which reservoir projects the lower end of the nozzle 29. A valve member 68 is associated with the cup 63 and is disposed within the reservoir 67 substantially adjacent the lower end thereof. The valve member 68 is, in the illustrated embodiment, fixedly connected to the cup 63 as by being press fitted thereto. The valve member 68 preferably comprises a rounded projecting body having a convex exterior valve surface, which surface in the illustrated embodiment preferably comprises a substantially semispherical surface so as to create a desired seating relationship with the valve seat 54 formed on the lower end of the nozzle 29.

As is substantially conventional with valve mechanisms of this type, a supply conduit 71 is interconnected to the body structure 41 by means of an elbow 72 for supplying a gaseous fuel into the interior chamber 44 so as to burn off the undesired gases such as oxygen, during the passage thereof through the valve mechanism.

OPERATION

The operation of the valve mechanism 11, and its relationship to the overall apparatus 10, will be briefly described to insure a complete understanding thereof.

Figure 3:
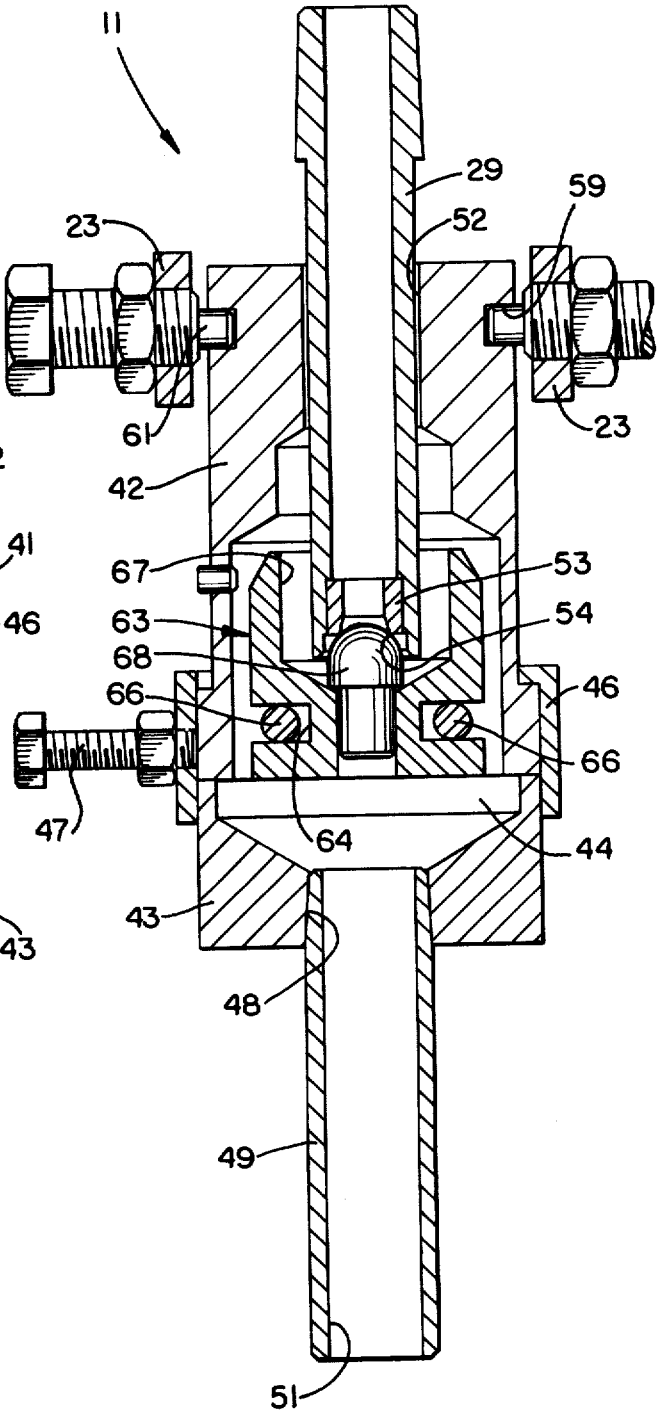
FIG. 3 is a central sectional view of the valve mechanism taken substantially along line III—III in FIG. 2.

The valve mechanism 11, and the overall operating apparatus 13, is normally maintained in the position illustrated in FIGS. 1 and 3, in which position the valve mechanism 11 is closed due to the valve member 68 being maintained in an uppermost position wherein it is seated against the valve seat 5. When a predetermined quantity of molten metal is to be supplied to the mold 12, then pressure fluid such as air is supplied to the upper end of cylinder 26 so that the piston rod is extended downwardly, thereby causing a downward clockwise swinging of lever 17 about its pivot 22. This in turn causes a downward counterclockwise swinging of upper lever 16 about its pivot 21. This swinging of upper lever 16 causes the body structure 41 of the valve mechanism 11 to be slidably moved axially downwardly relative to the nozzle 29, so that valve member 68 moves downwardly out of engagement with the valve seat 54. This thus permits a predetermined quantity of molten metal to flow through nozzle 29 and downwardly past the valve member 68 into the interior chamber 67 defined by the cup 63. This chamber 67 is already filled with molten metal due to the previous cycle of operation, so that the desired quantity of molten metal spills over the upper edge of the cup 63 into the interior chamber 44, and then flows downwardly through the spout 49 for deposit into the ladle 31. After the valve has been open a predetermined time, which in turn determines the predetermined amount of molten metal dispensed, the actuating cylinder 26 is reversely pressurized to thereby swing the levers 16 and 17 upwardly and hence move the body structure 41 upwardly to thereby close the valve mechanism 11.

When the valve mechanism 11 is in both its open and closed positions, as described above, the interior chamber 67 of the cup 63 remains completely filled with hot molten metal, so that the valve member 68 and valve seat 54 are thus continuously immersed within the hot molten metal and are thus prevented from being exposed to the surrounding atmosphere. This thus prevents oxidation from occurring in surrounding relationship to the valve member of valve seat, and hence prevents the buildup of deposits.

In the event that distortions occur in the valve mechanism, such as due to the high temperature of the molten metal, the cup 63 can easily be sidewardly or horizontally displaced as necessary due to its slidable and rotatable support on the pins 66, so as to permit the valve member 68 to automatically recenter and thus properly align with the nozzle 29.

The valve mechanism 11 can be easily and efficiently disassembled, if desired, by first loosening the screw or bolt 58 so as to remove same from the slot 59. Thereafter the other screw 47 is loosened to thereby disconnect the cap 46 from the lower cup member 43. Cap 46 can then be axially slid upwardly onto the upper body member 42 so that the upper and lower body members 42 and 43 can then be totally axially disconnected if desired. This also enables the pins 67 to be slidably removed from the upper body member 42, and hence the cup 63 can be totally removed if desired. The complete valve mechanism is obviously reassembled in the reverse sequence.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed as defined as follows:

1. In a battery grid casting machine having a mold, a movable filling ladle for supplying a preselected quantity of molten metal to said mold, a nozzle member connected to a source of molten metal, and valve means for dispensing said preselected quantity of molten metal from said nozzle member into said ladle, said valve means including a housing cooperating with said nozzle member and defining therein a valve member adapted for movement between open and closed positions relative to said nozzle member, said housing defining a discharge passage for supplying molten metal into said ladle, and means for moving said valve member relative to said nozzle member between said open and closed positions, comprising the improvement wherein said valve member includes an upwardly opening cup member defining therein an upwardly opening compartment, said nozzle member having a lower discharge end which projects downwardly into said compartment, said valve member also including a valve portion associated with said cup member and positioned for engaging the lower discharge end of said nozzle member when said valve member is in said closed position, said discharge passage communicating with said compartment at an elevation above said valve portion so that said cup member continuously contains therein a predetermined quantity of molten metal in surrounding relationship to said valve portion.

2. A machine according to claim 1, wherein said housing is slidably supported for movement relative to said nozzle member in a longitudinal direction parallel to the axial direction thereof for enabling said valve member to be moved between said open and closed positions, said valve member being mounted on said housing for movement therewith along said longitudinal direction, the lower discharge end of said nozzle member being completely continuously immersed in the molten metal contained within said cup member even when said valve member is in said open position.

3. A machine according to claim 2, wherein said housing comprises a tubular structure which is coaxially slidably supported relative to said nozzle member, said tubular structure defining therein an interior chamber, said cup member being positioned within said interior chamber, and mounting means coacting between said cup member and said tubular structure for permitting said cup member to be transversely displaced relative to the longitudinal direction of said tubular structure so as to enable said valve member to automatically align with the discharge end of said nozzle member.

4. A machine according to claim 3, wherein said tubular structure includes a discharge tube projecting downwardly below said cup-shaped member and disposed in substantial coaxial alignment with said nozzle member. said discharge passage being defined within the interior of said discharge tube and by said interior chamber.

5. A machine according to claim 3, wherein said valve portion comprises a projection which is fixed to said cup member and projects upwardly from the interior bottom wall thereof so as to sealingly engage an annular valve seat as defined adjacent the lower discharge end of said nozzle member.

6. A machine according to claim 5, wherein said projection has a rounded exterior valve surface thereon positioned for engagement with the annular valve seat formed on said nozzle member.

7. A machine according to claim 3, wherein said tubular structure includes upper and lower cup-shaped members disposed in opposed and engaged relationship so as to define said chamber therebetween, said upper cup-shaped member being coaxially slidably supported on said nozzle member, and said tubular structure also including means for fixedly but releasably connecting said upper and lower cup-shaped members together.

8. In a battery grid casting machine for supplying a preselected quantity of molten metal to a mold, said machine including a nozzle member connected to a source of molten metal and valve means associated with said nozzle member for controlling flow therefrom to said mold, said valve means including a body structure which is axially slidably supported relative to said nozzle member for movement relative thereto in a direction substantially parallel to the axial direction of said nozzle member, said valve means also including a valve member mounted on said body structure and being movable therewith for opening and closing said nozzle member, comprising the improvement wherein said valve member is axially fixed relative to said body structure, said valve member including a support portion disposed below the discharge end of said nozzle member and a valve portion fixed to said support portion and projecting toward the discharge end of said nozzle member, said valve portion having a rounded convex exterior valve surface adapted for engagement with the discharge end of said nozzle member, and mounting means cooperating between said valve member and said body structure for permitting said valve member to be transversely displaced relative to said body structure and relative to said nozzle member to insure automatic alignment of said valve portion with the discharge end of said nozzle member, said mounting means preventing any rotation of said valve member about any axis transverse to said axial direction.

9. A machine according to claim 8, wherein said mounting means permits said valve member to rotated in its entirety about an axis parallel to said axial direction.

10. A machine according to claim 9, wherein said support portion has an annular groove formed therein in surrounding relationship thereto, and said mounting means including a pair of pins mounted on said body structure and extending transversely thereof, said pins being engaged within said annular groove on substantially diametrically opposite sides thereof for enabling said support portion to move transversely relative to said axis while also enabling said support portion to rotate about the axis of said nozzle member.

* * * * *